US006253971B1

(12) United States Patent
Cobb

(10) Patent No.: US 6,253,971 B1
(45) Date of Patent: Jul. 3, 2001

(54) FLUID DISPENSING DEVICE

(76) Inventor: Raymond A. Cobb, 7 S. Washington St., North Attleboro, MA (US) 02760

( * ) Notice: Subject to any disclaimer, the term of this patent is extended or adjusted under 35 U.S.C. 154(b) by 0 days.

(21) Appl. No.: 09/439,273

(22) Filed: Nov. 12, 1999

(51) Int. Cl.[7] ..... B65D 83/00
(52) U.S. Cl. ..... 222/402.1; 222/527; 239/337; 239/588
(58) Field of Search ..... 222/402.1, 527; 239/337, 587.1, 588

(56) References Cited

U.S. PATENT DOCUMENTS 5,529,226 * 6/1996 Alberth et al. ..... 222/402.1
5,788,129 * 8/1998 Markos ..... 222/538
6,105,826 * 8/2000 Oursin et al. ..... 222/402.1

* cited by examiner

*Primary Examiner*—Joseph A. Kaufman
(74) *Attorney, Agent, or Firm*—Robert J Doherty

(57) ABSTRACT

An attachment device for pressurized fluid dispensing containers enabling augmented directional dispensing through a somewhat flexible tube such as a plastic straw wherein the tube is supported at a position outwardly removed from its positioning vis-à-vis the actuation nozzle and preferably radially outward of the vertical plane formed by the container body wall.

5 Claims, 5 Drawing Sheets

FLUID DISPENSING DEVICE

BACKGROUND AND OBJECTS OF THE INVENTION

The present invention relates to a device adapted for attachment to the top of a pressurized container of the type having an upwardly extending spray nozzle actuator top wall including a circular lip surrounding the spray head and more particularly to a device which positions a flexible dispensing tube with respect to the spray nozzle such that pressurized fluids contained within the container can be applied accurately and easily to relatively inaccessible locations.

Many fluids come in pressurized containers and are designed to be applied by means of a spray nozzle affixed to a valve in the top of the container. Typically, fluid is released by depressing the spray nozzle head, which causes the valve in the top of the container to open allowing fluid to be released through a fluid passage located on the side wall of the spray nozzle. In addition, it is common in some applications to provide a small diameter tube that can be inserted into frictional engagement with the exit opening of the nozzle head. When so mounted, the small diameter tube provides an extension to the nozzle head and allows the fluid stream to exit at the distal opening of the tube rather than at the exit opening of the nozzle head against which the proximal end of the tube is engaged. This allows application of the pressurized fluid into areas where the nozzle head would not provide thorough or accurate application of the fluid. The extension tube is typically provided along with the pressurized fluid container and is commonly affixed to the container by means of an adhesive strip.

It is also known to, in effect, attach such a spray tube to a container by holding such in tethered relationship while in use by a flexible line as shown in U.S. Pat. Nos. 5,058,783 and 5,788,129 and to temporarily support such tubes in a storage position as shown by U.S. Pat. No. 4,664,300 . In addition, it is known to attempt to support such tubes in their use position by support devices which to some extent are supported or attached to the top of the pressurized container such as shown in U.S. Pat. Nos. 4,858,792 and 5,297,704. It is also known to provide a malleable guide member for supporting an extra long flexible tube in its use position such as shown in U.S. Pat. No. 5,529,226 in order to better enable the tube or, in effect, dispensing line to reach inaccessible locations.

A number of recurring problems in this technology area are not however, addressed by the constructions shown in the aforementioned patents including the tendency of the tube at its engagement point with the spray head nozzle to become dislodged when held too tightly in relationship thereto. Thus, the provision of a secure tube holding means, which is simple, low, cost and easy to utilize is an object of the present invention.

These and other objects of the present invention are accomplished by a device having support means that is adapted to be firmly positioned on the container lip via a retainer ring and which includes a clamp mechanism which in turn holds the dispensing tube in a position distally removed from the spray head nozzle but in which both adjustability of the tube laterally with respect to the clamping mechanism is available when desired and wherein the retaining ring is removable for use on other containers when necessary.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best modes presently contemplated for carrying out the present invention.

DETAILED DESCRIPTION OF THE INVENTION

Figure 1:
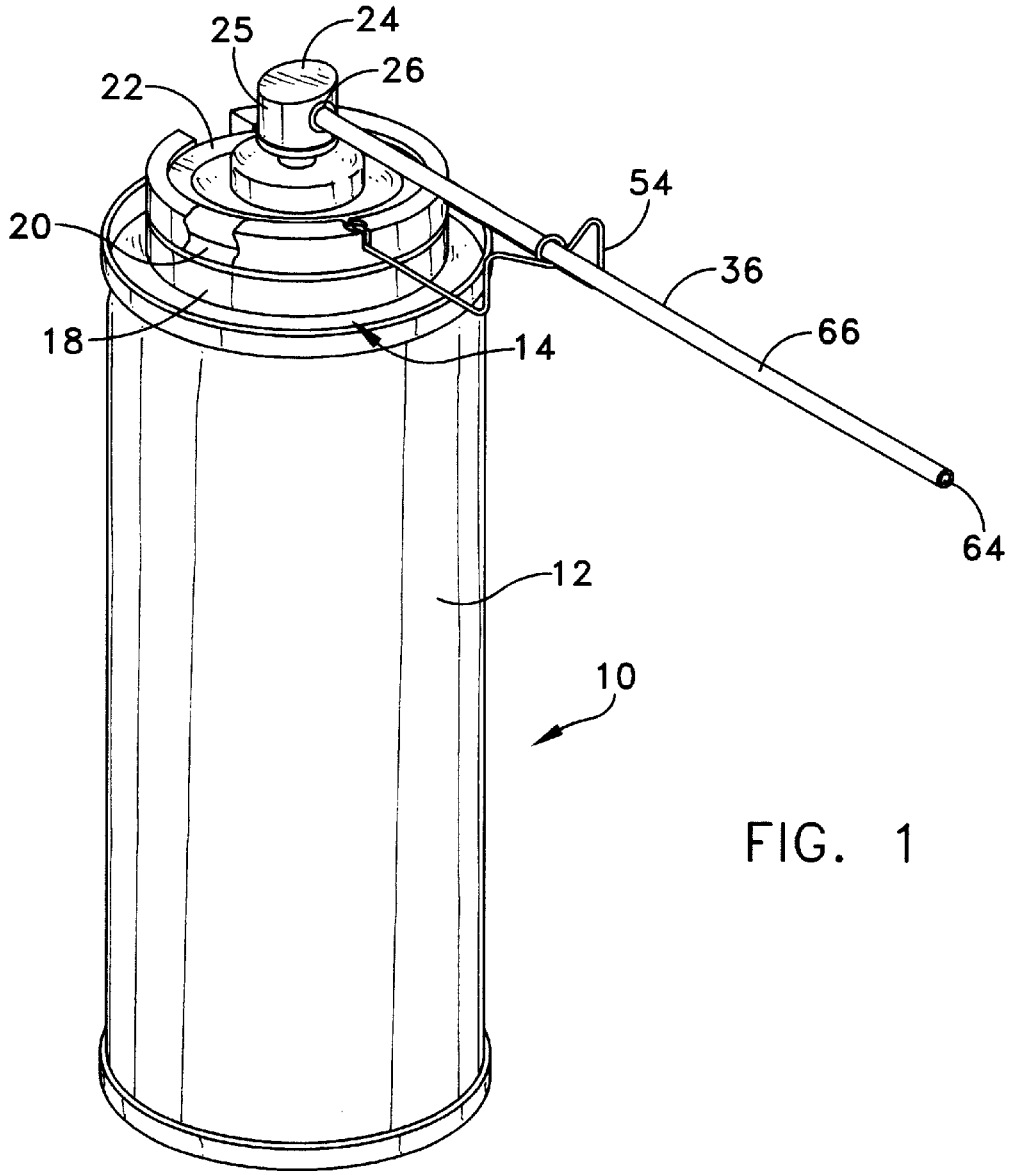
FIG. 1 is a perspective view of a conventional pressurized fluid container having one form of the device of the present invention mounted thereon in its operational mode.
Figure 2:
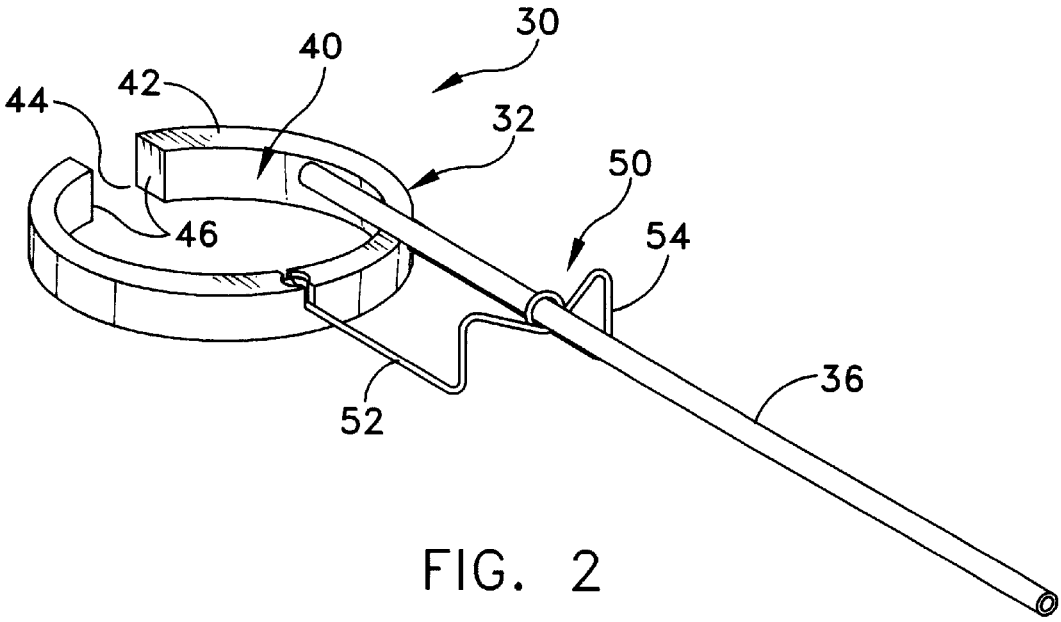
FIG. 2 is a perspective view of the FIG. 1 form of the device of the present invention separated from the container as shown in FIG. 1.
Figure 3:
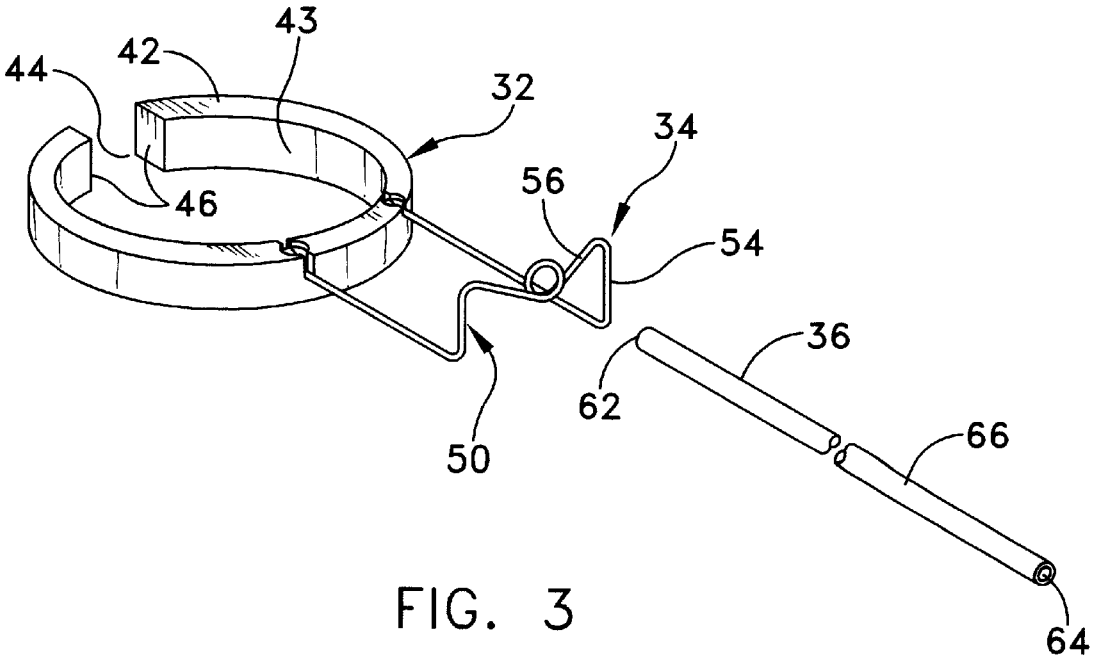
FIG. 3 is a view similar to FIG. 2 but in exploded form wherein the dispensing tube is removed therefrom.

Referring to FIG. 1, a pressurized fluid container 10 of the type, which is standardly available and with which the device of the present invention is particularly adapted for use is shown. Such container includes a body 12 and a top wall 14 to which a valve assembly is attached during assembly of the container. The resultant structure includes an upwardly extending shoulder 18 including an inwardly extending ledge 20 and an upwardly terminating lip 22. The valve assembly includes an upwardly extending actuator button or spray nozzle 24. Vertically downward depression of the actuator button 24 releases fluid from the nozzle 26 located on a lateral side thereof. The nozzle 26 is normally recessed within the side wall 25 of the actuator button 24 and thus enables the proximal end of a flexible dispensing tube to be placed within the recess and in operational contact with the nozzle opening when such spray direction is desired as in the case of the present invention. One form of the device 30 of the present invention is shown in FIG. 2, which device includes three major portions, namely, a retaining ring 32 by which the device is attached to the container, a support means 34 extending from the ring and a dispensing tube 36 which is positioned in the desired operational engagement with the nozzle of the container actuator button 24 by the support means.

The retaining ring 32 is preferably formed from a metallic composition such as aluminum or from a plastic resinous material having similar physical properties and includes a body 40 including an upper wall 42, an inner wall 43 and an opening 44 such that the overall ring configuration is that of a split ring and presents opposed face walls 46 which can be leveraged apart by an implement such as a screw driver so as to enable the ring 32 to be mounted upon the container and removed from. Such mounting is preferably such that the inner wall 43 of the ring surrounds the outer wall of the container lip 22 and may rest upon the shoulder ledge thereof. The ring 32 is of a slightly lesser interlal diameter than the outer diameter of the lip 22 but can be, in effect, sprung apart to enable the ring to be mounted as desired as by outward force applied to the faces 46. This provides for a firm positioninig of the device vis-à-vis the container.

Figure 8:
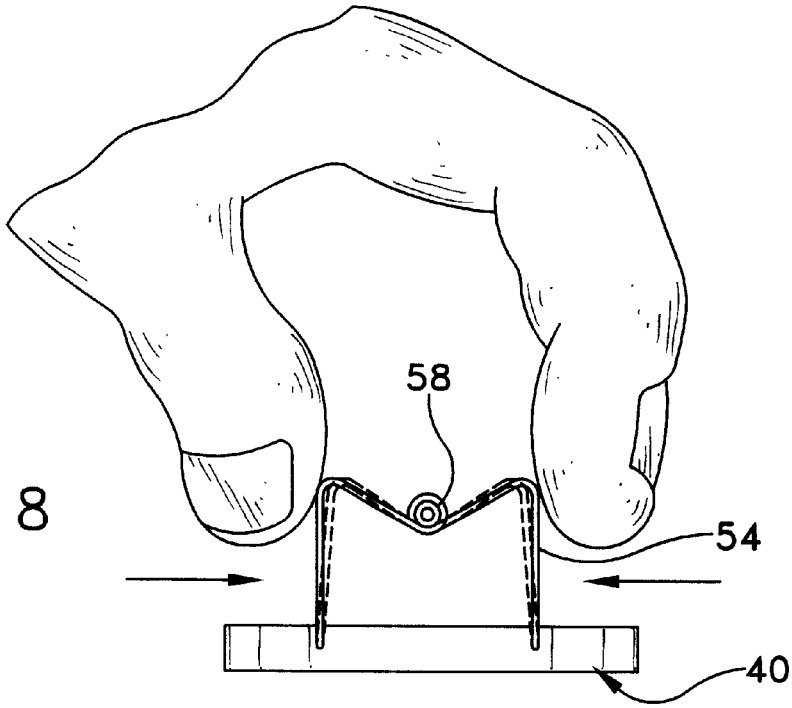
FIG. 8 is a view showing how the clamping means shown in FIGS. 1 through 7 may be released to enable the tube to move laterally with respect thereof.

The support 34 includes a mechanism for attachment to the retaining ring and a clamping portion 50 by which the support can grasp and firmly position the tube 36 in the desired relationship with the nozzle. The means for attaching the support to the ring includes a pair of preferably metal spring wire primarily arms 52 outwardly laterally extending from the upper wall 42 and terminating in the clamping means 50 which comprises a pair of upwardly directed secondary arms 54 which, in part, define a cross member 56 which in turn defines a circular receiver portion or bore 58 which receives an intermediate portion of the tube 36. The tube 36 may be a hollow flexible plastic tube having a proximal end 62, a distal end 64 and intermediate body 66, in the embodiment shown in FIGS. 1 through 8 of the drawings, it should be noted that the bore 58 is defined by a single winding or ring of the wire but could be composed of multiple windings thereof should more lateral support be required. One of the advantages of the single or lower multiple winding bore is that the shoulders formed by the terminal portions of the secondary arms may the inwardly squeezed and thus, in effect, opened to increase the diameter of the bore 58 in order to enable the intermediate portion of the tube to be moved relative thereto and position the tube in the desired location. Such squeezing action is shown in particular in FIG. 8 and forms a particularly convenient manner in order to adjust the tube positioning as desired.

Figure 1A:
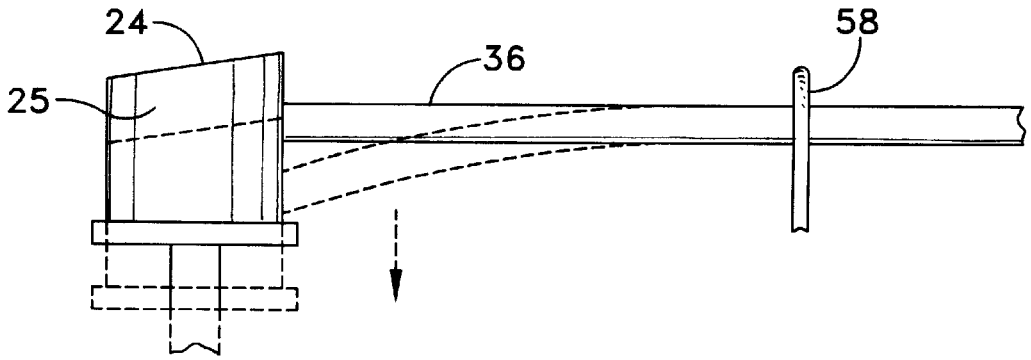
FIG. 1A is a partial side elevational view of FIG. 1 showing the manner in which the proximal tube portion may downwardly flex.

It should be noted and in particular by reference to FIG. 1A that the clamping bore and thus the position at which the intermediate portion of the tube is firmly grasped is substantially radially outwardly removed from the proximal tube end at a position outward of the upstanding lip 22 and preferably well outward of the vertical limits of the container body itself, Such positionino in effect lengthens the proximal portion of the tube, that is, that portion between its proximal end seated in the nozzle recess at the point at which it is grasped by the clamping means, which assures adequate tube flexibility such that nozzle actuation is accommodated. With very short proximal tube lengths, the overall stiffness of the tube is, in effect, increased and the vertical actuation movement of the nozzle can dislodge the tube proximal end from the recess. Furthermore by providing such greater length, the tube proximal portion can be slightly upwardly bent in its central area to better facilitate separation and repositioning of the proximal tube end in the nozzle recess when desired.

Figure 4:
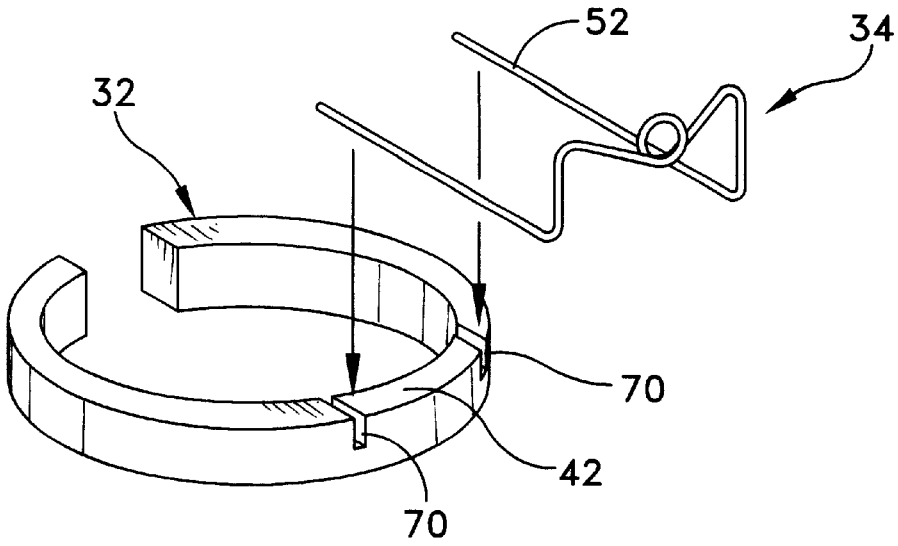
FIG. 4 is a view showing a preliminary step by which the clamping means may be attached to the retaining ring.
Figure 5:
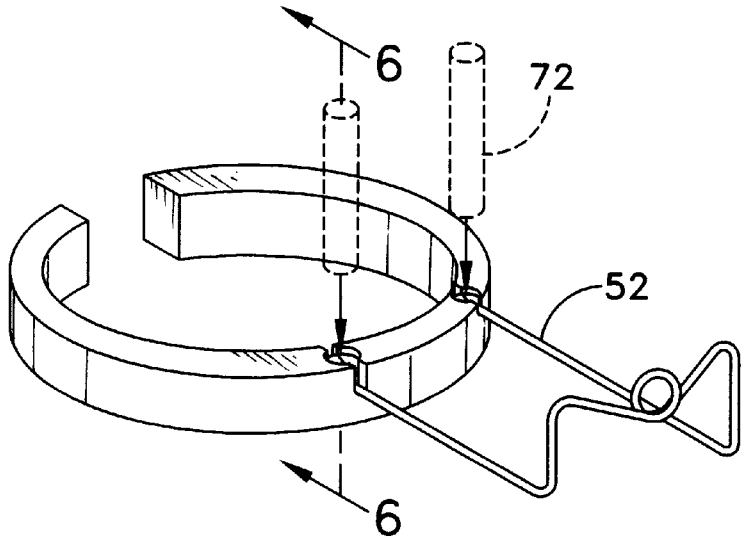
FIG. 5 is a view similar to FIG. 4 but showing a further constructional step for mounting the clamping means within the retaining ring.
Figure 6:
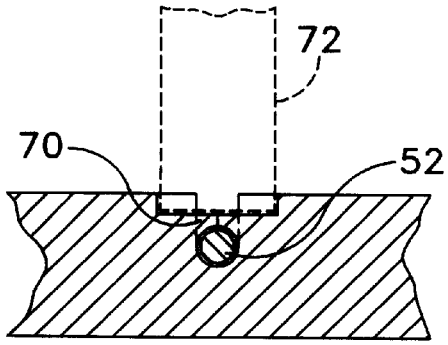
FIG. 6 is a side sectional view on an enlarged scale through the lines 6—6 of FIG. 5.
Figure 7:
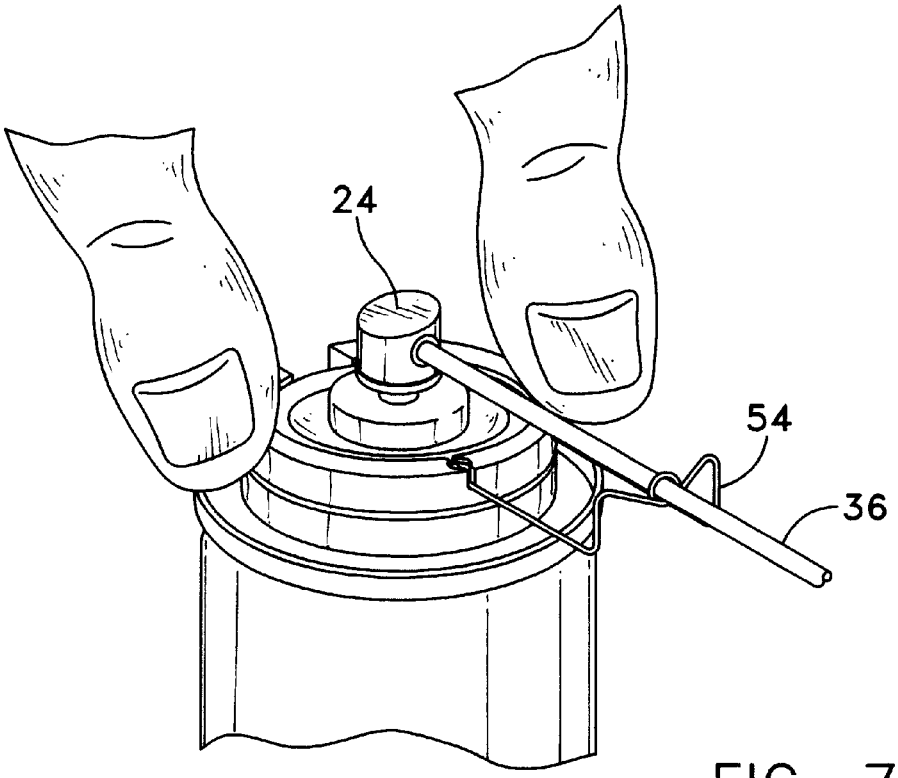
FIG. 7 is a partial perspective view similar to FIG. 1 showing the device of the present invention being mounted to the pressurized container.

Turning now to FIGS. 4 through 6, a manner in which the primary arms 52 of the support 34 may be attached to the retaining ring 32 is illustrated. Therein the upper wall 42 of the ring 32 is provided with a pair of slots 70 and thereafter terminal portions of the primary arms 52 positioned therein and then die members or punches 72 shown in dotted lines forced downwardly so as to reform a portion of the metal and/or plastic composition forming the ring 32 so as to force such material to a clamping relationship with the surrounding wall and thus retain the primary arms therewithin in a secure manner.

It should be again noted that the primary arms 52 laterally radially outwardly extend a relatively great distance so as to ensure that the clamping contact of the bore 58 with respect to the tube 36 is at a position which defines a relatively large length of tube material between the position at which it is clamped by the bore 58 and its proximal terminal end 62 positioned within the recess 28 or otherwise positioned against the nozzle in operational engagement.

It is also desirable that the support 34 as shown in FIGS. 1 through 8 provide a stiff yet not totally rigid support to the tube 36, that is, some slight flexibility to the legs 52 can be desirable in that their downward flexure from their connection points at the upper wall can enable the proximal end of the tube 62 to be tilted slightly upwardly by the downward tilt of the arms 52 so as to better be able to position and remove the tube from the nozzle recess 28 when desired.

Figure 9:
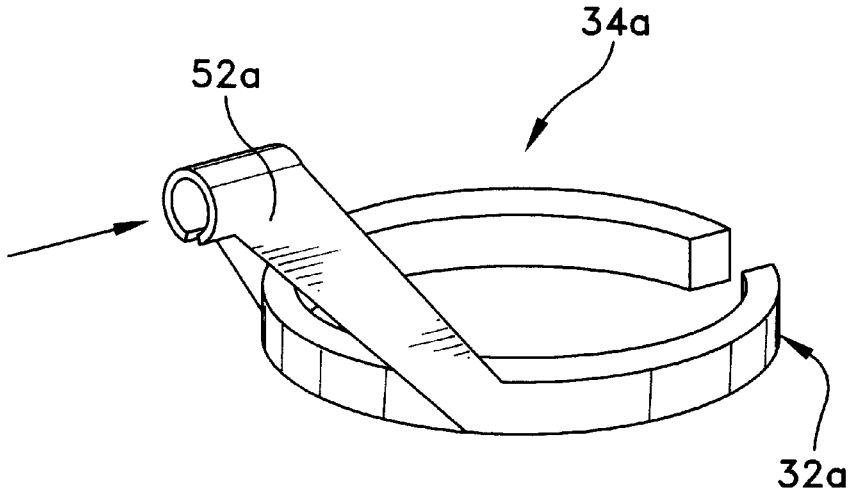
FIG. 9 is a perspective view of a different form of the clamping means of the present invention wherein the retaining ring and clamping means are integrally formed with each other.
Figure 10:
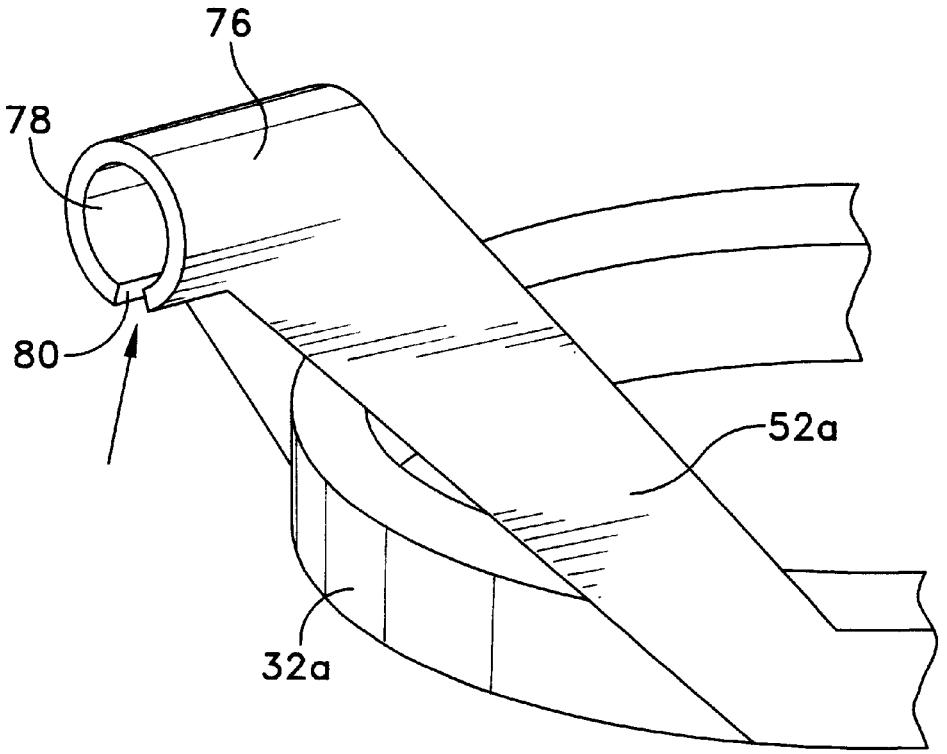
FIG. 10 in an enlarged partial view of FIG. 9 showing the means by which different tube sizes may be accommodated with respect to the clamping means.

Turning now to FIGS. 9 and 10 of the drawing, a modified form of the ring and support is shown wherein the support 34*a* is formed integrally with the ring 32*a*. In such case, the support 34*a* could be integrally cast from aluminum or other metal material or formed by injection molding procedures when formed of plastic resinous materials. In such cases, the primary arms 52*a* upwardly forwardly extend and terminate in a head 76 which includes a bore 78 therethrough similar to the bore 58 formed by the wire construction of the preceding embodiment. The head is slotted at opening 80 to provide a slight outward flexibility of the bore diameter so that the bore diameter may be increased to accept the insertion of the tube 36 therethrough in the desired position. Again, the tube is grasped by the bore 78 radially outwardly of the lip 22 and preferably outwardly of the container wall body 12 for the reasons indicated with reference to FIGS. 1 through 8.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A device for controlling the application of fluid from a pressurized container having a vertical body wall, a top wall having a spray nozzle head upwardly extending therefrom, said container top wall further including an upwardly extending circular lip surrounding the head and wherein the spray nozzle is disposed on a lateral side of the head for lateral dispensing of fluid therefrom comprising: a retaining ring having an at least partially circular wall adapted to fixedly engage said container lip, support means having proximal and distal ends connected at said proximal end to said retaining ring wall and radially outwardly extending from said retaining ring wall and said container top wall circular lip at its distal end, said support means distal end having clamping means including a collar having a bore laterally extending therethrough, a hollow flexible tube having proximal and distal ends and an intermediate body wherein the proximal end is adapted for operational fixed contact positioning by said supporting means against said nozzle to receive fluid therefrom when said spray nozzle head is downwardly depressed and wherein a portion of said intermediate body is firmly positioned within the bore of said collar at a position substantially radially outwardly removed from said nozzle so as to provide a length of tube positioned between the tube proximal end and the tube intermediate body portion clamped in said collar bore which is of a materially greater length than the radial extent of said container top wall lip so as to assure tube flexibility in such extent so as to better accommodate vertical bending movement of the tube proximal end as by nozzle actuation, said support means including a pair of stiff primary arms outwardly radially extending from said retaining ring wall and terminating in said clamping means.

2. The device of claim 1, said retaining ring being of split construction.

3. The device of claims 1, said support means being of spring wire and wherein said primary arms outwardly terminate in at least one circular portion which defines said bore.

4. The device of claim 3, said at least one circular portion defined by a circular winding of said wire, said primary arms defining a pair of laterally spaced shoulder portions on opposite sides of said bore whereby inward pressure on said shoulders outwardly flexes said circular winding so as to increase the diameter of said bore.

5. The device of claim 1, said collar bore positioned radially outwardly of the vertical extent of said container body wall.

* * * * *